US007347069B2

(12) United States Patent
Talpe

(10) Patent No.: US 7,347,069 B2
(45) Date of Patent: Mar. 25, 2008

(54) LOCK AND KEEPER SET

(76) Inventor: Joseph Talpe, Oudenaardsesteenweg 543, B-8581, Avelgem-Kerkhove (BE)

( * ) Notice: Subject to any disclaimer, the term of this patent is extended or adjusted under 35 U.S.C. 154(b) by 123 days.

(21) Appl. No.: 11/136,899

(22) Filed: May 25, 2005

(65) Prior Publication Data

US 2005/0262905 A1 Dec. 1, 2005

(30) Foreign Application Priority Data

May 26, 2004 (EP) ..... 04102324

(51) Int. Cl.
*E05B 15/02* (2006.01)

(52) U.S. Cl. ..... 70/107; 70/102; 70/418; 292/340; 292/341.18; 292/346; 292/DIG. 39; 292/DIG. 40; 292/DIG. 41; 292/DIG. 55

(58) Field of Classification Search ..... 70/136, 70/450, 107–111, 416–418, 1.5, 102; 49/394, 49/395, 460, 462; 292/340, 346, 341.18, 292/341.19, 341.13, 341.12, DIG. 39, DIG. 17, 292/DIG. 73, DIG. 40, DIG. 41, DIG. 51, 292/DIG. 55
See application file for complete search history.

(56) References Cited

U.S. PATENT DOCUMENTS 489,220 A * 1/1893 Currier et al. ..... 292/1
557,772 A * 4/1896 De Arden ..... 292/337
769,770 A * 9/1904 Phelps ..... 292/341.18
1,361,702 A * 12/1920 Falls ..... 292/123
1,853,456 A * 4/1932 Ross ..... 292/346
1,873,528 A * 8/1932 Anstine ..... 292/341.19
2,749,164 A * 6/1956 Kitzelman ..... 292/121
2,761,722 A * 9/1956 Wilfert et al. ..... 292/341.12
3,831,988 A * 8/1974 Stelma ..... 292/302
4,915,428 A * 4/1990 Hayakawa ..... 292/29

(Continued)

FOREIGN PATENT DOCUMENTS

FR 1.484.779 6/1967

(Continued)

*Primary Examiner*—Lloyd A. Gall
(74) *Attorney, Agent, or Firm*—DLA Piper US LLP

(57) ABSTRACT

A lock that includes a frame which is arranged to be secured on the outside against a first side of a tubular member of a hinged gate and at least one bolt which is arranged to extend through the tubular member, out of a second side thereof, into the keeper device. The keeper device is mounted on a fixed member, which is usually a pole arranged in the ground. In order to make it more difficult to force the gate open by inserting, for example, a crowbar between the gate and the fixed member, the lock and keeper set comprises a security device arranged to prevent the gate and the fixed member from being forced apart sufficiently to disengage the bolt from the keeper device. This security device includes a first security piece arranged to be secured to the frame of the lock and to project from the second side of the tubular member to extend, in the closed state of the gate, behind a second security piece on the keeper device.

24 Claims, 5 Drawing Sheets

U.S. PATENT DOCUMENTS 4,986,576 A * 1/1991 Anderson ..... 292/40
5,129,693 A 7/1992 Schmitt
6,481,158 B1 * 11/2002 Marks ..... 49/57
6,679,533 B1 * 1/2004 Bruner et al. ..... 292/346
6,684,669 B1 * 2/2004 Talpe ..... 70/107
6,837,082 B1 * 1/2005 Moore ..... 70/337
7,121,531 B1 * 10/2006 Gonzalez ..... 256/73
2003/0189341 A1 * 10/2003 Perry ..... 292/346

FOREIGN PATENT DOCUMENTS

GB 2 189 836 A 11/1987
NL 8800761 10/1989
WO WO 98/37295 8/1998

* cited by examiner

LOCK AND KEEPER SET

RELATED APPLICATION

This application claims priority of European Patent Application No. 04102324.3, filed May 26, 2004.

TECHNICAL FIELD

This disclosure relates to a set of a lock, which is arranged to be mounted on a hinged gate, and of a keeper device, which is arranged to be secured to a fixed member facing the hinged gate in a closed state thereof, the lock comprising a frame arranged to be secured on the outside against a first side of a tubular member of or fixed to the gate; at least one bolt, which is slidably mounted on the frame between a retracted and a projecting position and which is arranged to extend in its projecting position, in the closed state of the gate, through the tubular member, out of a second side thereof, into the keeper device to lock the gate; and an actuation mechanism arranged to move the bolt from its retracted to its projecting position and vice versa.

BACKGROUND

A lock and keeper set is already disclosed in EP-B-0 963 498 by the applicant. The lock disclosed in this European patent is fixed by means of externally threaded bushings against a first side of a tubular upright of a hinged gate so that the latch and dead bolt extend through the upright. The externally threaded bushings are applied over the latch and the dead bolt and are screwed through the same holes in the tubular upright into the frame of the lock.

EP-A-1 367 198, also filed by the applicant, discloses a similar lock wherein the bushings for securing the lock to the tubular upright are however internally threaded. These bushings are also applied over the latch and the dead bolt but are screwed onto an externally threaded tubular part of the frame instead of in the frame. In still a further variant of the lock disclosed in the above-mentioned patents, the lock is fixed by separate screws applied through holes next to the latch and dead bolt through the tubular upright of the gate.

The above-described prior art locks are especially intended for being applied to gates in fences around gardens, swimming pools, etc. This means that the locks and/or the keeper devices are usually fixed to poles. A problem with such applications is that it is rather easy to force the lock open by inserting a crowbar or similar instrument between the gate and the fixed member to which the keeper device is secured. The fixed member and the gate can more particularly be forced apart quite easily until the bolt is withdrawn from the keeper. A solution which is applied in practice consists in applying a chain and a padlock around the fixed member and the gate. However, such an additional locking system is not aesthetic and is quite cumbersome to apply.

Locks with security means for preventing opening of a door by inserting a jimmy or similar instrument between the door and its jamb and springing the door and jamb apart until the latch bolt is withdrawn from its strike plate are already known in the early nineteen-hundreds. Reference can be made for example to U.S. Pat. No. 1,325,919, U.S. Pat. No. 1,359,347 and U.S. Pat. No. 1,462,828. The locks disclosed in those patents are however rim locks which are mounted against the front face of the door. In these locks, the bolt does not have to extend through an upright of the door. To provide the additional security, the housing of the lock is constructed to engage behind the keeper device when closing the door.

It would therefore be advantageous to provide a new lock and keeper set which makes it much more difficult to force the lock open.

SUMMARY

To this end, the lock and keeper set comprises security means for preventing, in the closed and locked state of the gate, the gate and the fixed member from being forced apart sufficiently to disengage the bolt from the keeper device, the security means comprising first security means arranged to be secured through a hole in the tubular member to the frame of the lock and to project from the second side of the tubular member to extend, in the closed state of the gate, behind second security means on the keeper device.

Since the first security means, which are secured through the tubular member of the gate to the lock, extend in the closed state of the gate behind the second security means on the keeper, it is no longer possible, at least not without destroying the first or second security means, to force the keeper device and the gate apart until the bolt is withdrawn from the keeper.

The lock is separated from the keeper device by the tubular member onto which it is mounted. Previously, no solution was available to increase the resistance of such locks against being forced open, notwithstanding the fact that the problem that such locks can be forced open quite easily existed already for a quite long time.

In an advantageous aspect of the lock and keeper set, the first security means are arranged to be screwed onto or into the frame of the lock to secure the frame of the lock to the tubular member of the gate. An advantage is that it enables to omit at least one of the bushings or screws which were used in the prior art locks to secure the lock against the tubular member of the gate. Moreover and more importantly, it enables a retrofit of the first security means onto the frame of existing locks. Instead of replacing the entire lock, only one of the securing elements has to be removed and replaced by the first security means.

BRIEF DESCRIPTION OF THE DRAWINGS

Other particularities and advantages of the lock and keeper set will become apparent from the following description of a particular structure of the lock and keeper set. The reference numerals used in this description relate to the annexed drawings wherein.

DETAILED DESCRIPTION

Figures 1, 9, 10:
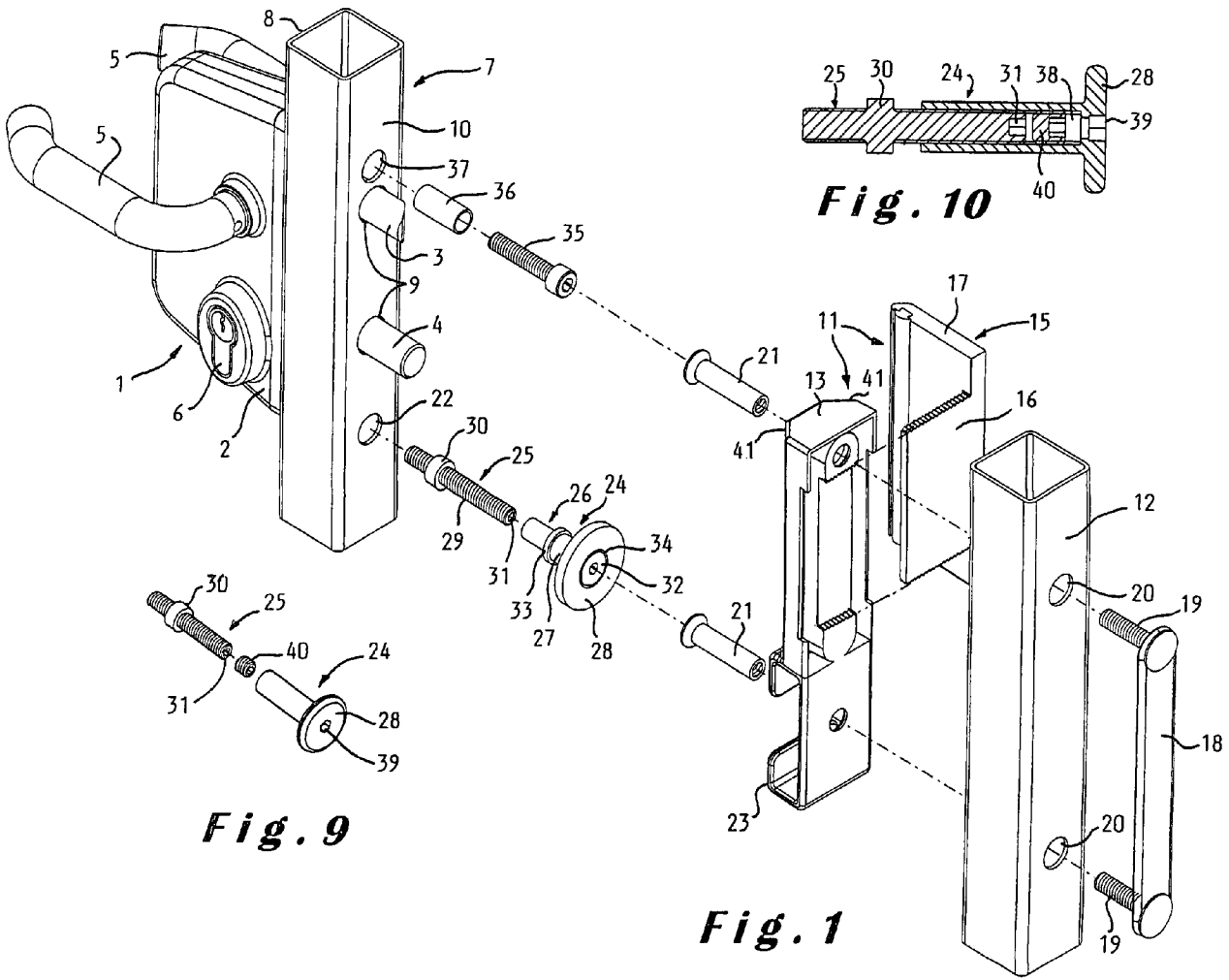
FIGS. 1 and 2 are exploded views on a lock and a keeper set.
FIG. 9 is an exploded view on a variant embodiment of the first security means illustrated in FIGS. 1 and 2.
FIG. 10 is a cross-sectional view through the first security means, in their assembled state, illustrated in FIG. 9.

It will be appreciated that the following description is intended to refer to specific representative structures selected for illustration in the drawings and is not intended to define or limit the disclosure, other than in the appended claims.

The lock 1 illustrated in the figures comprises a frame 2 and a latch bolt 3 and a dead bolt 4 which are each slidably mounted on the frame between a retracted and a projecting position The lock 1 comprises moreover an actuation mechanism to move the latch bolt 3 between its retracted and projecting positions and a further actuation mechanism for moving the dead bolt 4 between its retracted and projecting positions. The actuation mechanism of the latch bolt 3 comprises two handles 5 mounted onto a common shaft whilst the actuation mechanism of the dead bolt 4 comprises a key operated lock cylinder 6. The internal actuation mechanism of both bolts 3, 4 is not part of the present invention and will therefore not be described further into detail. Instead, for a more detailed description of possible actuation mechanisms, reference is made to EP-B-0 606 196, EP-B-0 963 498 and EP-A-1 118 739, the disclosures of which are incorporated herein by reference.

An essential feature of the lock 1 is that it is arranged to be mounted in such a manner against a tubular member 7 of a hinged gate that the bolt or bolts extend through this tubular member 7. The lock 1 is more particularly secured to a first side 8 of the tubular member 7 so that its bolt or bolts 3 and 4 project through openings 9 on the opposite second side 10 of the tubular member 7 out of this member. In case it is not desired to make holes or openings into the tubular member of the gate itself, or in case the upright of the gate is not tubular but for example a solid wooden beam, it is also possible to use a short piece of a tubular member and to secure that piece of tubular member to the front side of the upright of the gate. This can be done for example by means of an additional metal plate piece which can be welded to the second side of the tubular member and fixed, for example screwed, to the lateral side of the upright of the gate. In this way, the screws used for securing the tubular member to the gate cannot be unscrewed in the closed position of the gate. The term "gate" is understood in its broadest meaning including any hinged closure device, in particular also doors etc.

Figure 8:
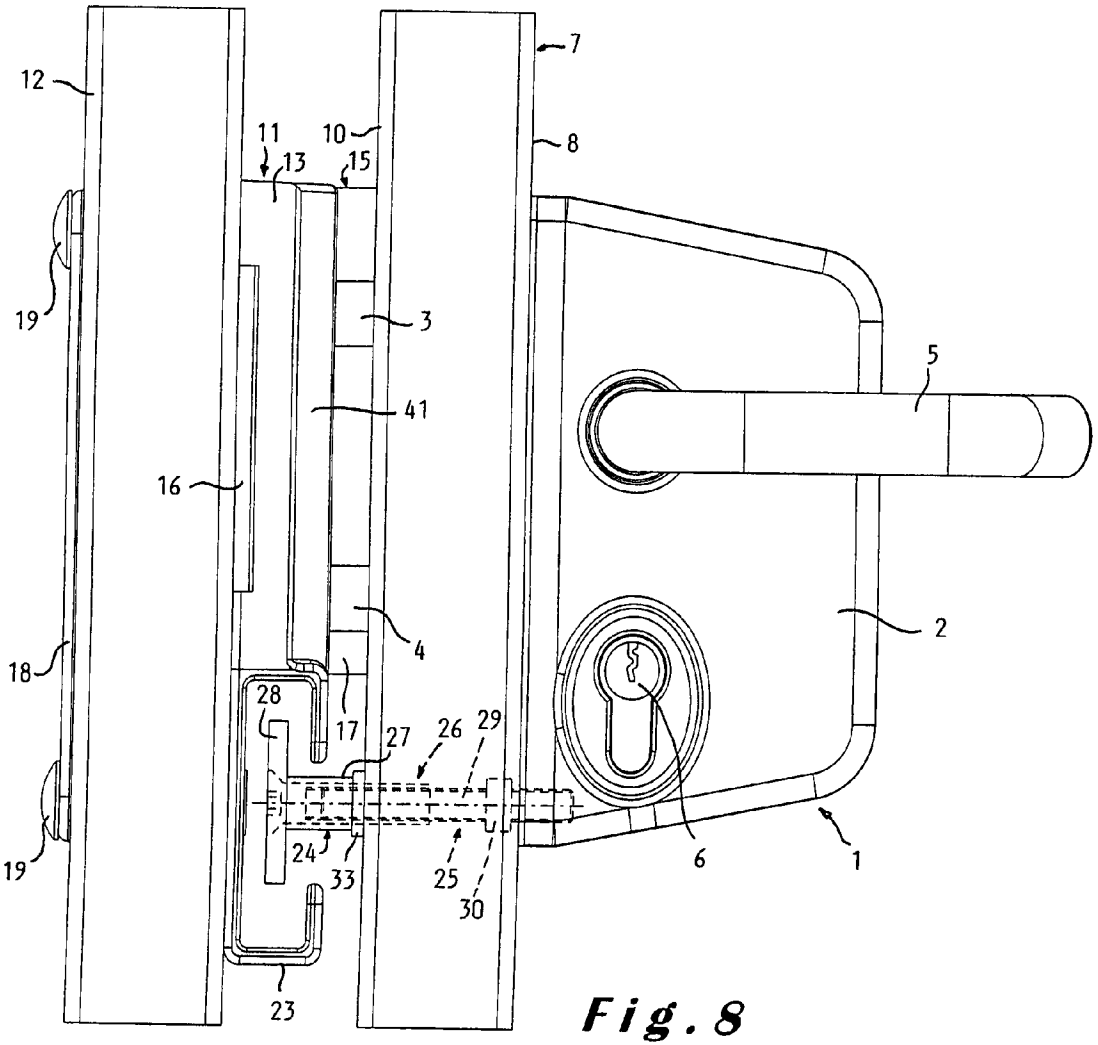
FIG. 8 is a front elevational view on the lock mounted onto the tubular member of a gate and the keeper device mounted onto the fixed member, with the gate being closed and locked.

As illustrated in FIG. 8, the latch and the dead bolt are arranged to project through the tubular member of or on the gate into a keeper device 11 mounted on a fixed member 12. The fixed member 12 may be a pole fixed into the ground or a wall or other fixed element. The fixed member may even be the other gate of a double gate, more particularly the gate which can usually be fastened by means of a bolt to the ground.

In the same way as disclosed in EP-B-0 963 498 the keeper device 11 comprises a first part 13 showing a recess 14 for receiving the latch and dead bolt and a second, generally L-shaped part 15, having one leg 16 clamped between the first part 13 and the fixed member 12 and one leg 17 forming a stop for the gate. The keeper device further comprises a lath 18 having fixed thereto two bolts 19 which are inserted through openings 20 into the fixed upright. For securing the keeper device 11 to the fixed member two elongated nuts 21, having an enlarged head, are screwed through openings into the first part 13 of the keeper device onto the bolts 19.

The second part 15 can be fixed in two different orientations with respect to the first part 13. In this way the keeper device can be adjusted to a left or a right turning gate. The leg 16 of the second part can moreover be clamped in different positions between the first part 13 of the keeper device 11 and the fixed member 12 in order to adjust the keeper device 11 to different diameters of the tubular member 7 of the gate. Mutually cooperating toothed surfaces on both the first and the second part enable different positions of the first and second parts of the keeper device while preventing the first and second parts to slide with respect to one another. In the keeper device disclosed in EP-B-0 963 498 the first part showed only on one side of the recess 14 an oblique striker surface. To change the orientation of the keeper device, also the first part had therefore to be positioned upside down. In the keeper device illustrated in the drawings, the first part 13 shows on both sides of the recess 14 a bevelled striker surface 41. In this way, the orientation of the first part has not to be changed when adjusting the keeper device to a right or a left turning gate.

The lock and keeper set described hereabove additionally comprises security means for preventing the gate and the fixed member 12 from being forced apart sufficiently to disengage in particular the dead bolt 4 from the keeper device 11 in the closed and locked state of the gate. The security means comprise first security means which are arranged to be secured through a hole 22 in the tubular member 7 to the frame 2 of the lock 1 so as to project from the second side 10 of the tubular member 7 to extend, in the closed state of the gate, behind second security means on the keeper device 11.

The second security means on the keeper device 11 show one or more so-called "undercuts" seen from the gate. These undercuts are constructed in such a manner that, when closing the gate, the first security means are brought in a position wherein they extend behind the undercuts. In the embodiment illustrated in the figures, the second security means are composed of a C-profile 23. This C-profile is substantially C-shaped in a cross-section parallel to the gate so that the first security means move in the (substantially horizontal) gap between the two legs of the C-profile when closing the gate. An advantage of such a C-profile is that it prevents the security means from being disengaged by forcing the gate up- or downward.

Figure 2:
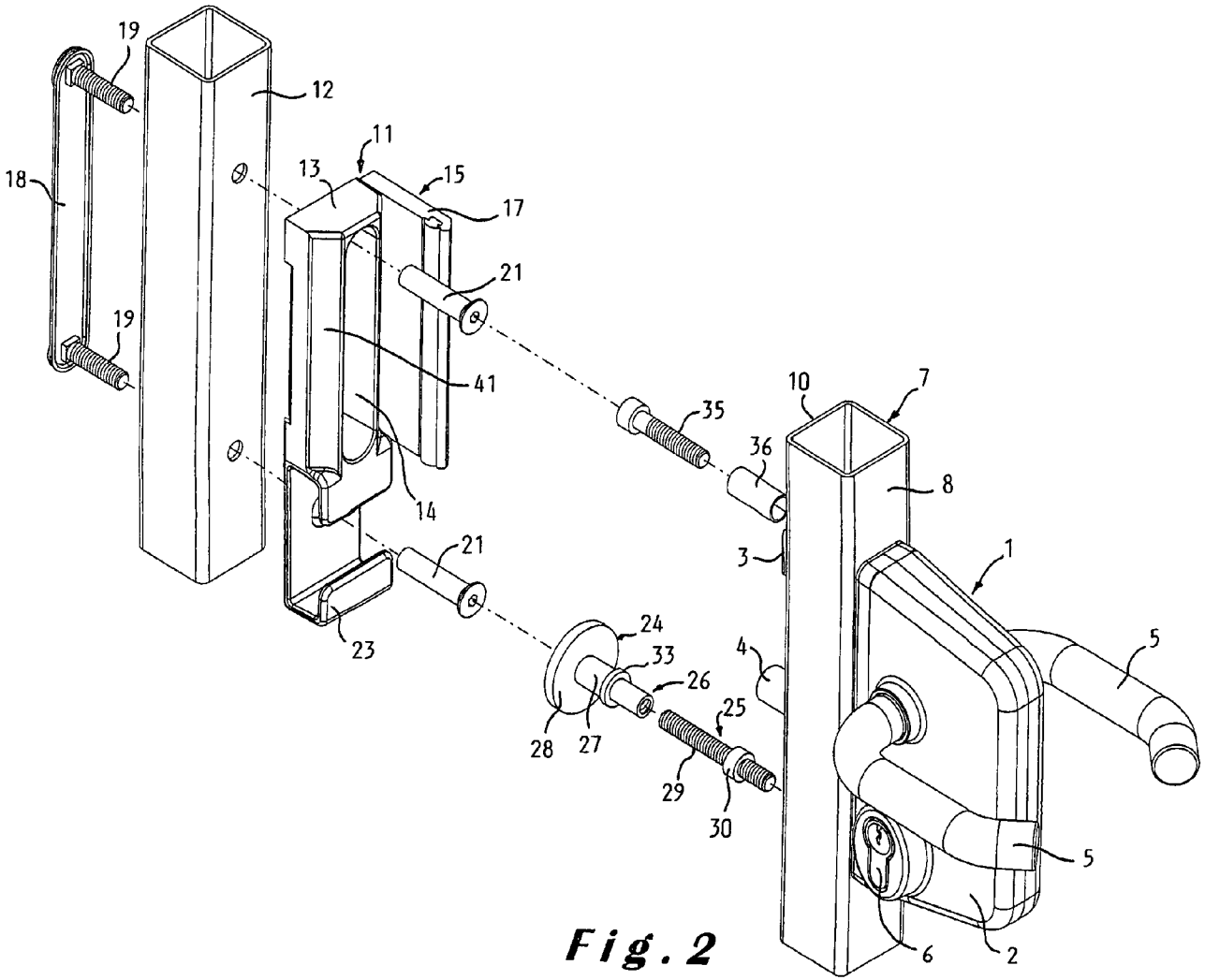
Figure 3:
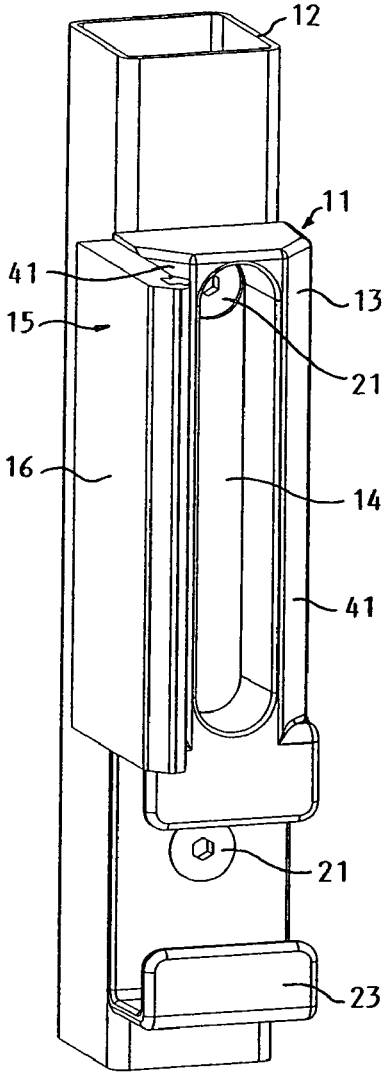
FIGS. 3 and 4 are perspective views on the keeper device mounted onto a fixed member.
Figure 4:
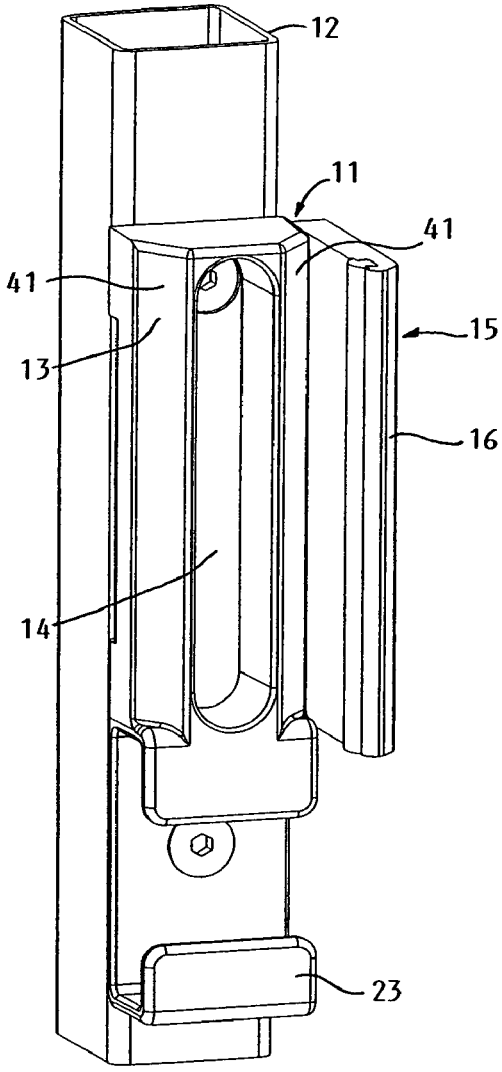
Figure 5:
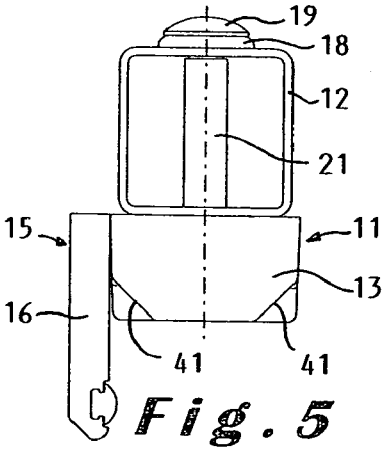
FIGS. 5 and 6 are top plan views on the keeper device illustrated in FIGS. 3 and 4.
Figure 6:
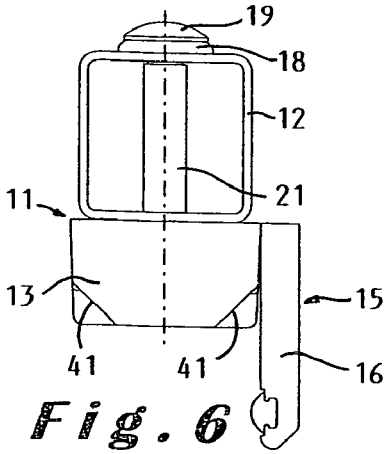
Figure 7:
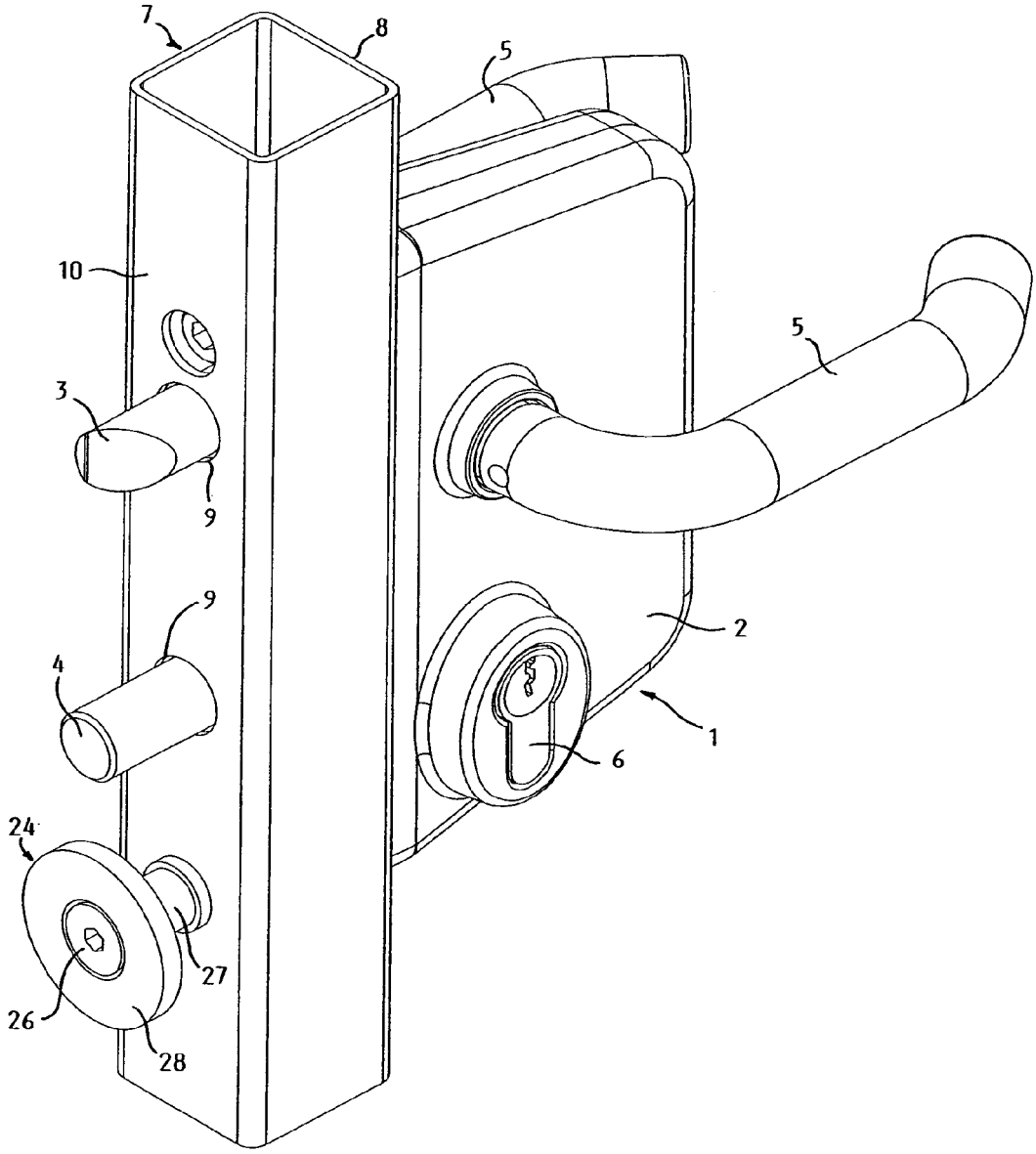
FIG. 7 is a perspective view on the lock mounted onto a tubular member.

In the structure illustrated in FIGS. 1 and 2, the first security means, which are arranged to engage behind the second security means on the keeper device 11, are composed of three elements 24, 25 and 26.

The first element 24 is arranged to extend in the closed state of the gate behind the legs of the C-shaped second security means on the keeper device 11. It comprises a stem portion 27 and a head portion 28. The head portion 28 projects laterally from the stem portion and engages, in the closed state of the gate, in the undercuts behind the legs of the C-shaped security means while the stem portion 27 extends in the gap between the two legs. The head portion 28 is constructed in the form of a substantially circular disk so that it is not possible to disengage the head portion 28 from the C-profile by rotating it around its longitudinal axis.

The first element 24 is fixed to the frame 2 of the lock 1 through the intermediary of the second element 25. This second element is an elongate screw threaded element, in particular a bolt 29, arranged to be screwed into the frame of the lock. The bolt 29 is provided with a collar 30 which has a diameter smaller than the diameter of the hole 22 on the second side in the tubular member but larger than the hole in the opposite first side of the tubular member so that the collar of the bolt 29 engages the inside of the wall of the tubular member 7 to secure the lock to the tubular member.

In order to enable to tighten the bolt 29, it is provided with a hexagonal recess 31 in its end face.

Since the bolt 29 has no head, the first element can be screwed onto this bolt. In the embodiment illustrated in FIGS. 1 and 2, the first element 24 is not screwed directly onto the second element 29 but instead indirectly, through the intermediary of the third element 26. This third element 26 is an elongate tubular screw threaded element which is provided with a head 32 and which is applied through an axial hole in the first element 24. It has an internal screw thread so that it can be screwed onto the second element 25 to secure the first element 24 to the lock. The stem of this first element 24 is provided with a collar 33 which has a diameter larger than the diameter of the hole 22 in the tubular member 7 so that, when tightening the third element 26 onto the second element 25, it is pressed against the second side 10 of the tubular member 7. In this way, the first element is very rigidly fixed to the tubular member. The head 32 of the third element 26 is preferably countersunk in a recess 34 in the end face of the first element 24. In the closed position of the gate, it is thus not possible to release the third element 26. The first element can normally not be rotated due to the pressure exerted thereon by the third element. However, even if it would be possible to rotate the first element, it can still not be unscrewed from the second element 25 due to the fact that it would rotate freely over the third element 26. In the illustrated embodiment, the security means are thus fixed very reliable to the frame of the lock and to the tubular member.

An advantage of these security means is that, due to the considerably distance of overlap between the second and the third element, the security means can be applied for different diameters of the tubular member 7. Independent of the diameter of the tubular member, the first element always projects over a same distance from the second side thereof. A further advantage of the first security means illustrated in the figures is that they can be secured to the lock in the threaded hole in the frame thereof instead of the fixation bolts used in the prior art. Such a fixation bolt 35 is still used in the lock illustrated in the figures to secure the lock at its upper side to the tubular member 7. Use is made hereto of a bushing 36 which can pass through the opening 37 in the second side of the tubular member 7 but not through the opening in the opposite first side thereof. The first security means, which are secured to the frame 2 of the lock 1, can thus be retrofitted onto existing locks.

FIGS. 9 and 10 illustrate another structure of the first security means. These means comprises also a first and a second element 24 and 25. The second element 25 is identical to the second element 25 illustrated in FIGS. 1 and 2. The first element 24 is however provided with an internally screw threaded axial boring 38 so that it can be screwed directly onto the second element 25. For rotating the first element 24, it is provided with a hexagonal hole 39 in the end face of its head portion 28 ending into the axial boring 38. The first element 24 has no collar 33 so that it cannot only be adjusted in function of the diameter of the tubular member 7 but the distance between its head portion 28 and the tubular member 7 can also be adjusted. This distance can more particularly be adjusted to the distance between the tubular member and the keeper device 11 on the fixed member 12. In order to lock the first element 24 in the appropriate position onto the second element 25 a lock bolt 40 is screwed in the axial boring 38 against the end face of the second element extending in this axial boring 38. To enable to tighten the lock bolt 40, it is provided with a hexagonal recess 41. This hexagonal recess 41 has a smaller diameter than the hexagonal hole 39 in the end face of the first element 24 so that the lock bolt 40 can be tightened by means of a hexagonal key inserted through the hexagonal hole 39 into the axial boring 38.

Within the scope of the claims, the structures illustrated in the figures can for example be modified as follows.

The second element 25 of the first security means could be tubular, and could be internally screw threaded, so that it can be screwed onto a screw threaded part of the frame projecting into the tubular member. When a system with bushings is used which are applied over the latch and dead bolt to secure the lock as disclosed in EP-B-0 963 498 or EP-A-1 367 198, it is also possible to use tubular first, second and third elements which are applied over the latch or dead bolt so that the latch or dead bolt projects, at least in its projected position, through these elements. Compared to such an embodiment, the embodiment illustrated in the figures offers however the advantage that the gap between the gate and the fixed member does not have to be increased.

Instead of providing a lock with a latch and a dead bolt, the lock could also be provided with only one bolt. This bolt may be a dead bolt or a latch bolt which can be locked in its projected position.

Although this disclosure has been described in connection with specific forms thereof, it will be appreciated that a wide variety of equivalents may be substituted for the specified elements described herein without departing from the spirit and scope of this disclosure as described in the appended claims.

The invention claimed is:

1. A set of a lock arranged to be mounted on a hinged gate, and a keeper device arranged to be secured to a fixed member facing the hinged gate in a closed state thereof, the lock comprising:

a frame arranged to be secured on one side against a first side of a tubular member of or fixed to said gate;

at least one bolt mounted on the frame such that the bolt is slidable in the closed state of the gate towards and away from the keeper device between a retracted and a projecting position and arranged to extend in its projecting position, in the closed state of the gate, through said tubular member, out of a second side thereof, into said keeper device to lock the gate; and an actuation mechanism arranged to move said bolt from its retracted to its projecting position and vice versa, wherein the lock and keeper set comprises security means for preventing, in the closed and locked state of the gate, the gate and the fixed member from being forced apart sufficiently to disengage the bolt from the keeper device, the security means comprising first security means arranged to be secured through a hole in said tubular member to the frame of the lock and project from said second side of the tubular member to extend, in the closed state of the gate, behind one or more undercuts, seen from the gate, formed by second security means on the keeper device.

2. The lock and keeper set according to claim 1, wherein said first security means are screwed onto or into the frame of the lock to secure the frame of the lock to said tubular member.

3. The lock and keeper set according to claim 1, wherein said first security means comprise a first element arranged to extend in the closed state of the gate behind the second security means on the keeper device and a second element arranged to secure the first element to the frame of the lock.

4. The lock and keeper set according to claim 3, wherein the second element is an elongate screw threaded element screwed onto or into the frame of the lock.

5. The lock and keeper set according to claim 4, wherein the tubular member has a wall and the second element engages, at the first side of the tubular member, an inner side of said wall to secure the frame of the lock to the tubular member.

6. The lock and keeper set according to claim 3 or 4, wherein the first element is screwed onto or into the second element.

7. The lock and keeper set according to claim 6, wherein the first element is screwed onto or into the second element through the intermediary of a third element, comprising a further elongate screw threaded element provided with a head, the first element having an axial hole arranged to receive the third element for securing the first element to the frame of the lock.

8. The lock and keeper set according to claim 7, wherein the head of said third element is countersunk in a recess in an end face of said first element.

9. The lock and keeper set according to claim 3, wherein said first element is pressed on the outside against said second side of the tubular member.

10. The lock and keeper set according to claim 6, wherein a lock bolt or lock nut is provided on the first or on the second element to lock the first element in a predetermined position with respect to the second element.

11. The lock and keeper set according to claim 3, wherein said first element comprises a stem portion and a head portion, which head portion projects laterally from the stem portion and extends in the closed state of the gate behind the second security means on the keeper device.

12. The lock and keeper set according to claim 1, wherein the second security means on the keeper device are generally C-shaped in a cross-section parallel to the gate.

13. The lock and keeper set according to claim 1, wherein the keeper device comprises at least two parts, a first part of which comprises said second security means and a recess for receiving said bolt while a second part of which comprises a generally L-shaped part, a first leg of which forming a stop for the hinged gate and a second leg being arranged to be fixed to the first part of the keeper device, the first part having on both sides of the recess a bevelled striker surface and the connection between the second leg and the first part enabling fixation of the second part of the keeper device in two different orientations to the first part to enable to adapt the keeper device to a left or a right turning gate.

14. The lock and keeper set according to claim 13, wherein the connection between the second leg and the first part of the keeper device is arranged to fix the first part of the keeper device in different positions with respect to the second part to adjust the distance between the recess in the first part and the first leg of the second part of the keeper device.

15. A set of a lock arranged to be mounted on a hinged gate, and a keeper device arranged to be secured to a fixed member facing the hinged gate in a closed state thereof, the lock comprising:

a frame arranged to be secured on one side against a first side of a tubular member of or fixed to said gate;

at least one bolt mounted on the frame such that the bolt is slidable in the closed state of the gate towards and away from the keeper device between a retracted and a projecting position and arranged to extend in its projecting position, in the closed state of the gate, through said tubular member, out of a second side thereof, into said keeper device to lock the gate; and an actuation mechanism arranged to move said bolt from its retracted to its projecting position and vice versa, wherein the lock and keeper set comprises a security device for preventing, in the closed and locked state of the gate, the gate and the fixed member from being forced apart sufficiently to disengage the bolt from the keeper device, the security device comprising a first security piece arranged to be secured through a hole in said tubular member to the frame of the lock and project from said second side of the tubular member to extend, in the closed state of the gate, behind one or more undercuts, seen from the gate, formed by a second security piece on the keeper device.

16. The lock and keeper set according to claim 15, wherein said first security piece is screwed onto or into the frame of the lock to secure the frame of the lock to said tubular member.

17. The lock and keeper set according to claim 15, wherein said first security piece comprises a first element arranged to extend in the closed state of the gate behind the second security piece on the keeper device and a second element arranged to secure the first element to the frame of the lock.

18. The lock and keeper set according to claim 17, wherein said first element comprises a stem portion and a head portion, which head portion projects laterally from the stem portion and extends in the closed state of the gate behind the second security piece on the keeper device.

19. The lock and keeper set according to claim 15, wherein the second security piece on the keeper device is generally C-shaped in a cross-section parallel to the gate.

20. The lock and keeper set according to claim 15, wherein the keeper device comprises at least two parts, a first part of which comprises said second security piece and a recess for receiving said bolt while a second part of which comprises a generally L-shaped part, a first leg of which forming a stop for the hinged gate and a second leg being arranged to be fixed to the first part of the keeper device, the first part having on both sides of the recess a beveled striker surface and the connection between the second leg and the first part enabling fixation of the second part of the keeper device in two different orientations to the first part to enable to adapt the keeper device to a left or a right turning gate.

21. A set of a lock arranged to be mounted on a hinged gate, and a keeper device arranged to be secured to a fixed member facing the hinged gate in a closed state thereof, the lock comprising:

a frame arranged to be secured on one side against a first side of a tubular member of or fixed to said gate;

at least one bolt slidably mounted on the frame between a retracted and a projecting position and arranged to extend in its projecting position, in the closed state of the gate, through said tubular member, out of a second side thereof, into said keeper device to lock the gate; and an actuation mechanism arranged to move said bolt from its retracted to its projecting position and vice versa, wherein the lock and keeper set comprises security means for preventing, in the closed and locked state of the gate, the gate and the fixed member from being forced apart sufficiently to disengage the bolt from the keeper device, the security means comprising first security means arranged to be secured through a hole in said tubular member to the frame of the lock and project from said second side of the tubular member to extend, in the closed state of the gate, behind second security means on the keeper device, said first security means comprising a first element arranged to extend in the closed state of the gate behind the second security means on the keeper device and a second element arranged to secure the first element to the frame of the lock, the first element being screwed onto or into the second element through an intermediary of a third element, comprising a further elongate screw threaded element provided with a head, the first element having an axial hole arranged to receive the third element for securing the first element to the frame of the lock.

22. A set of a lock arranged to be mounted on a hinged gate, and a keeper device arranged to be secured to a fixed member facing the hinged gate in a closed state thereof, the lock comprising:

a frame arranged to be secured on one side against a first side of a tubular member of or fixed to said gate;

at least one bolt slidably mounted on the frame between a retracted and a projecting position and arranged to extend in its projecting position, in the closed state of the gate, through said tubular member, out of a second side thereof, into said keeper device to lock the gate; and an actuation mechanism arranged to move said bolt from its retracted to its projecting position and vice versa, wherein the lock and keeper set comprises security means for preventing, in the closed and locked state of the gate, the gate and the fixed member from being forced apart sufficiently to disengage the bolt from the keeper device, the security means comprising first security means arranged to be secured through a hole in said tubular member to the frame of the lock and project from said second side of the tubular member to extend, in the closed state of the gate, behind second security means on the keeper device, said first security means comprising a first element arranged to extend in the closed state of the gate behind the second security means on the keeper device and a second element arranged to secure the first element to the frame of the lock, the first element being screwed onto or into the second element and a lock bolt or nut provided on the first or on the second element to lock the first element in a predetermined position with respect to the second element.

23. A set of a lock arranged to be mounted on a hinged gate, and a keeper device arranged to be secured to a fixed member facing the hinged gate in a closed state thereof, the lock comprising:

a frame arranged to be secured on one side against a first side of a tubular member of or fixed to said gate;

at least one bolt slidably mounted on the frame between a retracted and a projecting position and arranged to extend in its projecting position, in the closed state of the gate, through said tubular member, out of a second side thereof, into said keeper device to lock the gate; and an actuation mechanism arranged to move said bolt from its retracted to its projecting position and vice versa, wherein the lock and keeper set comprises security means for preventing, in the closed and locked state of the gate, the gate and the fixed member from being forced apart sufficiently to disengage the bolt from the keeper device, the security means comprising first security means arranged to be secured through a hole in said tubular member to the frame of the lock and project from said second side of the tubular member to extend, in the closed state of the gate, behind second security means on the keeper device, the keeper device comprising at least two parts, a first part of which comprises said second security means and a recess for receiving said bolt while a second part of which comprises a generally L-shaped part, a first leg of which forms a stop for the hinged gate and a second leg arranged to be fixed to the first part of the keeper device, the first part having on both sides of the recess a bevelled striker surface and a connection between the second leg and the first part enabling fixation of the second part of the keeper device in two different orientations to the first part to enable to adapt the keeper device to a left or a right turning gate.

24. A set of a lock arranged to be mounted on a hinged gate, and a keeper device arranged to be secured to a fixed member facing the hinged gate in a closed state thereof, the lock comprising:

a frame arranged to be secured on one side against a first side of a tubular member of or fixed to said gate;

at least one bolt slidably mounted on the frame between a retracted and a projecting position and arranged to extend in its projecting position, in the closed state of the gate, through said tubular member, out of a second side thereof, into said keeper device to lock the gate; and an actuation mechanism arranged to move said bolt from its retracted to its projecting position and vice versa, wherein the lock and keeper set comprises a security device for preventing, in the closed and locked state of the gate, the gate and the fixed member from being forced apart sufficiently to disengage the bolt from the keeper device, the security device comprising a first security piece arranged to be secured through a hole in said tubular member to the frame of the lock and project from said second side of the tubular member to extend, in the closed state of the gate, behind a second security piece on the keeper device, the keeper device comprising at least two parts, a first part of which comprises said second security piece and a recess for receiving said bolt while a second part of which comprises a generally L-shaped part, a first leg of which forms a stop for the hinged gate and a second leg being arranged to be fixed to the first part of the keeper device, the first part having on both sides of the recess a beveled striker surface and the connection between the second leg and the first part enabling fixation of the second part of the keeper device in two different orientations to the first part to enable to adapt the keeper device to a left or a right turning gate.

* * * * *